United States Patent [19]

Braid et al.

[11] Patent Number: 4,507,216

[45] Date of Patent: Mar. 26, 1985

[54] HINDERED PHENYL ESTERS OF CYCLIC BORATES AND LUBRICANTS CONTAINING SAME

[75] Inventors: Milton Braid, Haddonfield; Andrew G. Horodysky, Cherry Hill, both of N.J.

[73] Assignee: Mobil Oil Corporation, New York, N.Y.

[21] Appl. No.: 474,951

[22] Filed: Mar. 14, 1983

[51] Int. Cl.[3] ..... C10M 1/10; C10M 3/02; C10M 7/02; C09F 5/08

[52] U.S. Cl. ..... 252/49.6; 44/76; 260/410.5; 260/410.6; 260/410.7; 260/410.8; 260/462 R

[58] Field of Search ..... 260/410.5, 410.6, 410.7, 260/410.8, 462 R; 44/76; 252/49.6

[56] References Cited

U.S. PATENT DOCUMENTS

| | | | |
|---|---|---|---|
| 3,133,951 | 5/1964 | Nützel et al. | 252/49.6 X |
| 3,151,077 | 9/1964 | Liao | 44/76 X |
| 3,347,793 | 10/1967 | Washburn et al. | 44/76 X |
| 3,356,707 | 12/1967 | Hinkamp | 44/76 X |
| 3,359,298 | 12/1967 | Hunter et al. | 44/76 X |
| 3,509,054 | 4/1970 | Hinkamp et al. | 44/76 X |
| 4,021,464 | 5/1977 | Mayerhoefer et al. | 260/462 R |
| 4,370,248 | 1/1983 | Horodysky et al. | 260/462 R X |
| 4,376,712 | 3/1983 | Horodysky et al. | 260/462 R X |

*Primary Examiner*—Helen M. S. Sneed

*Attorney, Agent, or Firm*—Alexander J. McKillop; Michael G. Gilman; Claude E. Setliff

[57] ABSTRACT

New reaction products obtained by reacting (1) a hindered phenol, (2) a borating agent and (3) a hydrocarbyl carboxylate are described. The preferred reaction sequence involves, first, the reaction of (1) and (2), then reacting the product obtained with the hydrocarbyl carboxylate.

Also described are lubricant or liquid fuel compositions containing a major proportion of lubricant or fuel and an antifriction, anticorrosion or fuel reducing amount of the reaction product of this invention and a method of reducing fuel consumption in an internal combustion engine by lubricating the engine therewith.

24 Claims, No Drawings

HINDERED PHENYL ESTERS OF CYCLIC BORATES AND LUBRICANTS CONTAINING SAME

BACKGROUND OF THE INVENTION

1. Field of the Invention

The invention is concerned with a novel group of compounds and their use as friction reducing, fuel economy, antioxidant and wear protection additives in lubricants and fuels.

2. Description of the Prior Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present therein.

Friction is also a problem any time two surfaces are in sliding or rubbing contact. It is of especial significance in an internal combustion engine, because loss of a substantial amount of the theoretical mileage possible from a gallon of fuel is traceable directly to friction.

Borate esters of hindered phenols, i.e. phenols in which both ring positions ortho to the hydroxy group have been substituted by bulky hydrocarbyl groups, are known in the art. U.S. Pat. No. 3,347,793, for example, teaches certain 2,6-di-t-alkylphenyl borates as oil additives. U.S. Pat. No. 3,356,707 and 3,359,298 disclose similar compositions. The hindered phenyl borate mixed esters of this invention are believed to be unknown.

SUMMARY OF THE INVENTION

In accordance with this invention, there is provided a reaction product prepared by reacting a hindered phenol, a borating agent and a hydrocarbyl carboxylate ester of a polyhydric alcohol in which at least two vicinal hydroxyl groups are available for borate esterification. The invention also provides lubricant and fuel compositions comprising a major proportion of lubricant or fuel and a minor, antifriction, fuel consumption reduction or antioxidant amount of said reaction product.

The hindered phenyl borate esters of this invention provide a significant combination of benefits not present in prior art compositions. The additives of this invention combine hydrolytic stability with friction reducing and oxidative stability properties unattainable using either hindered phenol borates or borates of hydrocarbyl carboxylate esters of polyhydric alcohol containing borated vicinal hydroxyl groups alone. The hindered phenyl borate esters of the invention, in addition to friction reduction impart to lubricant compositions resistance to oxidation and, moreover, do not hydrolyze to liberate boric acid, boroxides, metaboric acid, etc., to any significant extent.

DESCRIPTION OF SPECIFIC EMBODIMENTS

The reaction products of this invention, as has been noted, are made by reacting a boron compound, a hindered phenol and a hydrocarbyl carboxylate to yield the hindered phenyl borate ester. Preferably the reactions to form the product take place in two stages, the first of which is a reaction of the boron compound with the hindered phenol, followed by reaction of this product with the hydrocarbyl carboxylate. However, the sequence of reactions to form the products of this invention may be reversed so that the hydrocarbyl carboxylate and the boron compound react first followed by reaction of the resulting borate ester with the hindered phenol reactant. Alternatively, a suitable stoichiometric mixture of the hindered phenol, hydrocarbyl carboxylate, and boron compound may be subjected to suitable reaction conditions to bring about formation of the reaction products of this invention. Thus, the useful borating agent which is reacted with the hindered phenol is boric oxide or a compound of the formula $$(RO)_p(BO_2)_qZ_rY$$

wherein R, Y, and Z are hydrogen or alkyl groups containing 1 to 6 carbon atoms, p and r are 0 to 2, and q is 1 to 3.

The useful boron compounds covered by the above formula include boric acid, metaboric acid, alkyl metaborates, alkyl boroxines, boroxine boroxides, and the like, as well as the alkyl borates such as the mono-di-and trimethyl borates, the mono-, di- and triethyl borates, the mono-, di- and tripropyl borates, the mono-, di- and tributyl borates and the mono-, di- and trihexyl borates.

The hindered phenols that are contemplated have the formula

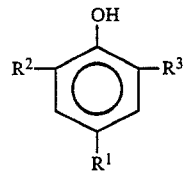

where $R^2$ and $R^3$ are the same or different alkyl groups containing 4 to 18 carbon atoms, preferably a tertiary alkyl group. Broadly, the carbon atoms of the alkyl group can be in any isomeric arrangement provided that the carbon atom bonded to the phenyl group is itself bonded to two other carbon atoms or chain segments. $R^1$ is hydrogen or a $C_1$ to $C_{30}$ hydrocarbyl group, i.e., an alkyl, alkenyl, cycloalkyl, aryl, aralkyl or alkaryl group which may have substituted thereon other groups, i.e., aralkoxy group, an alkylthio group or the like.

The useful hindered phenols include 2,6-di-t-butylphenol, 2,6-di-t-butyl-4-butoxyphenol, 2,6-di-t-butyl-4-carbobutoxyphenol and 3,5-di-t-butyl-4-hydroxybenzyl pivalate and the like.

The temperature of reaction of phenol and boron compound can be from about 75° C. to about 250° C., the precise temperature being selected on the basdis of the particular reactants used. A wide range of reactant proportions is contemplated, but will generally and preferably range from a mole ratio of boron containing compound to phenol of from about 0.1:1 to about 1:1.

The carboxylate that may be used in the practice of this invention is one coming within the formula $$R^4(OCOR^5)_n(OH)_t$$

wherein $R^4$ is a hydrocarbyl group containing 3 to 6 carbon atoms, $R^5$ is a hydrocarbyl group containing 6 to 25 carbon atoms, n is 1 to 3 and t is 2 to 3. "Hydrocarbyl," as used here, has the same meaning as above.

These esters can be purchased or made by methods well known in the art. In general, they are made by reacting the desired acid or acyl halide and alcohol at temperatures and for times one skilled in the art can easily select from the prior art. It should be noted that the alcohol used is one having at least 3 hydroxyl groups. Further, at least a significant proportion of the 2 hydroxyl groups remaining after esterification should be on adjacent carbon atoms of the chain $R^4$ or $R^5$.

Useful acid esters include such dihydroxyhydrocarbyl esters as 1,2-dihydroxypropyl oleate, sorbitan dioleate, mannitol dioleate, glycerol monostearate, glycerol monoisostearate, sorbitan monooleate, sorbitan monostearate sorbitan monoisostearate and glycerol monolaurate.

It is necessary that the intermediate product have at least one boron compound hydroxy group esterified with either the hindered phenyl group or the dihydroxy alkyl carboxylate reactant. Thus, the boron compound can initially be reacted with either the hindered phenol or with the defined hydroxylated carboxylate ester.

The reaction between the intermediate boron-phenol product and the carboxylate is carried out at from about 75° C. to about 325° C., depending primarily upon the carboxylate. The molar ratio of reactants, intermediate to carboxylate, will range from about 1:3 to about 3:1.

If the product is made by another scheme, e.g., by first reacting boron compound and carboxylate, then reacting this product with hindered phenol, similar temperatures will apply, and molar ratios of reactants should be chosen to give the proportions of the various moieties desired.

The structure

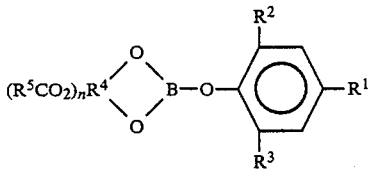

is strongly believed to represent the important major reaction product obtained by the method disclosed herein. The structure shown will be the same whether the sequence of reaction is (1) phenol-boron compound-carboxylate or (2) carboxylate-boron compound-phenol. While the reaction product may not consist solely of the structures represented, it is believed that there are substantial quantities thereof in the additive.

Of particular significance, in accordance with the present invention, is the ability to improve the fuel use, friction and oxidation properties of oleaginous materials such as lubricating media which may comprise either a mineral oil or a synthetic oil or mixtures thereof, or a grease therefrom. In general, mineral oils, both paraffinic and naphthenic oils, and mixtures thereof, employed as the lubricating oil or grease vehicle, may be of any suitable lubricating viscosity range. For example, they may range in viscosities of from about 45 SSU at 100° F. to about 6000 SSU at 100° F., and preferably, from about 50 to about 250 SSU at 210° F. These oils may have viscosity indexes ranging to about 100 or higher. Viscosity indexes from about 70 to about 95 are preferred. The average molecular weights of these oils may range from about 250 to about 800.

In instances where synthetic oils, or combinations thereof with mineral oils, are preferred, various compounds of this type may be successfully utilized. Typical synthetic vehicles include polyisobutylene, polybutenes, hydrogenated polyolefins, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis(p-phenoxy phenol)ether, phenoxy phenylethers. It is to be understood, however, that the compositions contemplated herein can also contain other materials. For example, detergents, dispersants, corrosion inhibitors, extreme pressure agents, viscosity index improvers, co-antioxidants, anti-wear agents and the like can be used, including metal phenates, metal sulfonates, metal or ashless phosphorodithioates, where the metals include calcium barium, magnesium and zinc, polymeric detergents, and silicone defoamants. These materials do not detract from the value of the compositions of this invention, but rather they serve to impart their customary properties to the particular compositions in which they are incorporated. In general, the preformed adducts of the present invention may be employed in any amount which is effective for imparting the desired degree of friction and fuel reduction anti-corrosion or anti-wear activity. In many applications, however, the adduct is effectively employed in amounts from about 0.1% to about 10% by weight, and preferably from about 0.5 to about 5% of the total weight of the composition.

With respect to the greases of the invention, a wide variety of thickening agents can be used to prepare them. Included among the useful thickening agents are alkali and alkaline earth metal soaps of fatty acids and fatty materials having from abut 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and coaps of low-, intermediate- and high-molecular weight acids and of nut oil acids.

Another group of thickening agents comprises substituted ureas, phthalocyanines, indanthrene, pigments such as perylimides, pyromellitdiimides, and ammeline.

The preferred thickening gelling agents employed in the grease compositions are essentially hydrophobic clays. Such thickening agents can be prepared from clays which are initially hydrophilic in character, but which have been converted into a hydrophobic condition by the introduction of long chain hydrocarbon radicals into the surface of the clay particles; prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, preferably from 3 percent to 15, percent by weight of the total grease composition.

The liquid fuels contemplated include liquid hydrocarbon fuels such as fuel oils, diesel oils and gasolines and alcohol fuels such as methanol and ethanol or mixtures of these fuels. The effective amount of additive therein for fuel use reduction will range from about 5 pounds to about 1000 pounds thereof per 1000 barrels of fuel, preferably from about 20 pounds to about 50 pounds per 1000 barrels.

The following Examples will present illustrations of the invention. They are illustrative only, and are not meant to limit the invention. Parts are by weight.

EXAMPLE 1(a)

2,6-Di-tert-butyl-4-methylphenyl Borate

A mixture of 2,6-di-tert-butyl-4-methylphenol (1980 g.), boric acid (93 g.) and xylene (200 ml) was heated while stirring vigorously at 145°-175° C. for 3.5 hours and water (28 ml) was collected by azeotropic distillation. During the next 12 hours increments of xylene (200 ml; total 400 ml) were periodically added, the temperature was raised to 200° C., and water (63 ml total) was collected. Solvent and unreacted alkylated phenol were removed by reduced pressure distillation, leaving the product, 2,6-di-tert-butyl-4-methylphenyl borate, as a tan solid.

EXAMPLE 1(b)

Reaction Product of 2,6-Di-tert-butyl-4-methylphenyl Borate With Glycerol Monooleate To the total product of Example 1(a) there were added glycerol monooleate (1125 g.) and toluene, and the mixture was heated at reflux to remove water azeotropically. There was collected a total of 65 ml of water. The residue after solvent stripping was a dark brown oil (1833 g.) which contained 1.81% of boron.

EXAMPLE 2(a)

2,6-Di-tert-butyl-4-methylphenyl Borate

Under a non-oxidizing (nitrogen) atmosphere, a mixture of 2,6-di-tert-butyl-4-methylphenol (5157 g.) and boric acid (482 g.) in xylene (1 liter) was heated while stirring at temperatures of 140°-200° C. for a total of about 13 hours during which water was removed azeotropically. The reaction mixture, in aliquot portions, was stripped of solvent and unreacted phenol by distillation at less than 0.1 mm pressure. The product was obtained as a yellow-tan solid (91%) containing 4.49% of boron (Theory, 4.09%).

EXAMPLE 2(b)

Reaction of 2,6-Di-tert-butyl-4-methylphenyl Borate with Glycerol Monooleate A mixture of 2,6-Di-tert-butyl-4-methyl phenyl borate (26 g) prepared as in Example 2(a) and glycerol monooleate (45.4 g) in xylene (900 ml) was heated at 138°-140° C. during 2.5 hours. The solvent was removed by reduced pressure distillation leaving the product (69.4 g) as a clear yellow oil.

EXAMPLE 3(a)

2,6-Di-tert butyl-4-methylphenyl Dibutyl Borate

In a moisture-protected atmosphere, 2,6-di-tert-butyl-4-methylphenol (1543 g) was heated to 245° C. and while stirring tributyl borate (805.5 g) was slowly added drop by drop. The addition rate was controlled to maintain the reaction temperature at 230°-250° C. and butanol was distilled from the mixture as formed. The distillate was fractionated to separate butanol from tributyl borate and the latter was recycled to the reacting mixture. The reaction mixture was heated at 250°-260° C. until no further distillation was observed.

EXAMPLE 3(b)

Reaction of 2,6-Di-tert butyl-4-methylphenyl Dibutyl Borate with Glycerol Monooleate To the reaction product mixture of Example 3(a) there was added glycerol monooleate (900 g.) and the resulting mixture was heated at 180°-270° C. until no further water or butanol azeotropically distilled. The mixture was stripped of solvent and volatiles under reduced pressure, leaving the mixed glyceryl monooleate-2-di-tert-butyl-4-methylphenol borate ester as a clear, clean golden, moderately viscous oil.

EXAMPLE 4

Reaction Product of 2,6-Di-tert-butyl-4-methylphenyl Dibutyl Borate with Glycerol Monooleate A mixture of 2,6-di-tert-butyl-4-methylphenyl dibutyl borate (198.4 g), glycerol monooleate (30 g.) and xylene (300 ml) was heated at 155° C. while butanol and water, if any, were removed by distillation. Solvent and other volatiles were removed by reduced pressure distillation, leaving the mixed borate ester product as a reddish brown oil.

EVALUATION OF THE COMPOUNDS

The compounds were evaluated in a low velocity friction apparatus (LVFA) in a fully formulated 5W-30 synthetic lubricating oil containing 20% by weight of an additive package including antioxidant, dispersant and detergent. The amount of friction reducing compound, as a weight percentage of the total weight of oil, is shown in the table. The Base oil had the following general characteristics:

| | | |
|---|---|---|
| Kinematic Viscosity | @ 100° C. | 10.6 cs |
| | @ 40° C. | 57.7 cs |
| Viscosity Index | 143 | 176 |

DESCRIPTION

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

Procedure

The rubbing surfaces and 12–13 ml. of test lubricants are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., 240 psi, and 40 fpm sliding speed. Afterward, measurements of $U_k$ vs. speed were taken at 240, 300, 400, and 500 psi. Freshly polished steel specimens are used for each run. The surface of the steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psi.

TABLE I

FRICTION CHARACTERISTICS

| Composition Tested | Additive Conc., Wt. % | % Reduction in Coefficient of Friction 5 Ft./Min. | 30 Ft./Min. |
|---|---|---|---|
| Base Oil | — | 0 | 0 |
| Base Oil plus | 4 | 21 | 22 |
| glycerol monooleate | 2 | 15 | 17 |
| Base Oil plus Example 1 product | 2 | 32 | 24 |
| Base Oil plus | 4 | 29 | 22 |
| Example 2(b) product | 2 | 25 | 18 |

The products were also evaluated for their oxidative stability in a 150 second solvent paraffinic neutral mineral oil. In most cases improvements in oxidative stability over the base oil were observed. In the test the sample lubricant is subjected to a stream of air which is bubbled through at the rate of 5 liters per hour at 325° F. for 40 hours. Present in the composition are samples of metals commonly used in engine construction, namely, iron, copper, aluminum and lead. See U.S. Pat. No. 3,682,980, incorporated herein by reference, for further details of the test. Improvement in viscosity index or neutralization number (or both) shows effective control. The results are shown in Table 2.

TABLE 2

| Composition Tested | Conc. of Additive Wt. % | Visc. Incr. @ °C., | Neutral No. Increase |
|---|---|---|---|
| Base Oil | — | 334 | 17 |
| Base Oil plus Glycerol Monooleate | 2 | 71 | 10.9 |
| Base Oil plus Example 1(b) Product | 2 | 50 | 4.6 |

BEARING CORROSION INHIBITING PROPERTIES

Two percent of the Example 1(b) product was blended into a fully formulated automotive engine oil (SAE 5W-30) containing detergent/dispersant and inhibitor additives and tested using the CRC L-38 engine test. At the end of the test, 40 hours, the bearing weight loss was measured to be 14 mg. Generally, a weight loss of less than 40 mg is considered good. The test was not terminated at this point, but continued for an additional 40 hours. The bearing weight loss at the end of a double-length test was found to be an exceptionally low 14 mg. The results clearly show the antioxidant and bearing corrosion inhibiting properties of this unique borate ester.

In the preparation of the subject reaction product, at least one other alternative synthesis may be used. While the synthesis has not been tested, it is contemplated that the reaction product can be prepared in a single step by placing together the hindered phenol, boron compound and acid ester.

The hindered phenyl esters of this invention, when placed in lubricating oils, substantially improve gasoline fuel economy in engine tests and significantly reduce the observed coefficients of friction when evaluated in bench-scale tests. Improvements in energy efficiency are expected in a wide variety of automotive and industrial lubricants containing additive concentrations of these non-metallic, non-phosphorus containing compositions. In addition, they are multifunctional additives which provide significant antioxidation properties not available in some other friction reducing additives. Other beneficial properties provided by these esters may include substantial antirust, dispersant/detergent, and antifatigue/metal hardening and related antiwear activity.

We claim:

1. A reaction product prepared by reacting (1) a hindered phenol of the formula

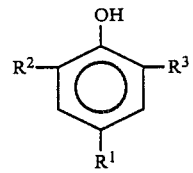

wherein $R^1$ is a $C_1$ to $C_{30}$ hydrocarbyl group and $R^2$ and $R^3$ are the same or different alkyl groups containing 4 to 18 carbon atoms, (2) a boron compound of the formula $(RO)_p(BO_2)_qZ_rY$ where R, Y and Z are selected from the group consisting of hydrogen and a $C_1$ to $C_6$ alkyl group, p and r are 0 to 2 and q is 1 to 3 and (3) a carboxylate ester of the formula $R^4(OCOR^5)_n(OH)_t$ wherein $R^4$ is a hydrocarbyl group containing 3 to 6 carbon atoms, $R^5$ is a hydrocarbyl group containing 6 to 25 carbon atoms, n is 1 to 3 and t is 2 or 3.

2. The product of claim 1 wherein said alkyl groups are tertiary alkyl groups.

3. The product of claim 1 wherein said hydrocarbyl groups are selected from the group consisting of alkyl, alkenyl, cycloalkyl, aryl, aralkyl and alkaryl.

4. The product of claim 1 wherein the hindered phenol is 2,6-di-tert-butyl-4-methylphenol, the boron compound is boric acid and the carboxylate ester is glycerol monooleate.

5. A lubricant or liquid fuel composition comprising a major amount of a lubricating oil or grease therefrom or of a liquid fuel and an antifriction, antioxidant or fuel consumption reducing amount of reaction product prepared by reacting (1) a hindered phenol of the formula

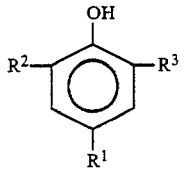

wherein $R^1$ is a $C_1$ to $C_{30}$ hydrocarbyl group and $R^2$ and $R^3$ are the same or different alkyl groups containing 4 to 18 carbon atoms, (2) a boron compound of the formula $(RO)_p(BO_2)_qZ_rY$ were R, Y and Z are selected from the group consisting of hydrogen and a $C_1$ to $C_6$ alkyl group, p and r are 0 to 2 and q is 1 to 3 and (3) a carboxylate ester of the formula $R^4(OCOR^5)_n(OH)_t$ wherein $R^4$ is a hydrocarbyl group containing 3 to 6 carbon atoms, $R^5$ is a hydrocarbyl group containing 6 to 25 carbon atoms, n is 1 to 3 and t is 2 or 3.

6. The composition of claim 5 wherein said alkyl groups are tertiary alkyl groups.

7. The composition of claim 5 wherein said hydrocarbyl groups are selected from the group consisting of alkyl, alkenyl, cycloalkyl, aryl, aralkyl and alkaryl.

8. The composition of claim 5 wherein the hindered phenol is 2,6-di-tert-butyl-4-methylphenol, the boron compond is boric acid and the carboxylate ester is glycerol monooleate.

9. The composition of claim 5 wherein said lubricant is (1) a mineral lubricating oil, (2) a synthetic lubricating oil or mixtures thereof, (3) mixtures of (1) and (2) and (4) a grease from any of (1), (2) and (3).

10. The composition of claim 9 wherein the lubricating oil is a mineral oil.

11. The composition of claim 9 wherein the lubricating oil is a synthetic oil.

12. The composition of claim 9 wherein the synthetic lubricating oil is a mixture of synthetic oils.

13. The composition of claim 9 wherein the lubricating oil is a mixture of (1) synthetic oil, or mixtures of synthetic oils, and (2) mineral oil.

14. The composition of claim 9 wherein the lubricant is a grease.

15. The composition of claim 5 wherein the liquid fuel is a liquid hydrocarbon or a liquid alcohol fuel, or mixtures thereof.

16. A method of reducing fuel consumption in an internal combustion engine which comprises lubricating and/or fueling said engine with a composition comprising a major amount of a lubricating oil or grease therefrom or a liquid fuel and an antifriction, antioxidant or fuel consumption reducing amount of reaction product prepared by reacting (1) a hindered phenol of the formula

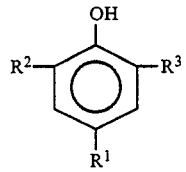

wherein $R^1$ is a $C_1$ to $C_{30}$ hydrocarbyl group and $R^2$ and $R^3$ are the same or different alkyl groups containing 4 to 18 carbon atoms, (2) a boron compound of the formula $(RO)_p(BO_2)_qZ_rY$ where R, Y and Z are selected from the group consisting of hydrogen and a $C_1$ to $C_6$ alkyl group, p and r are 0 to 2 and q is 1 to 3 and (3) a carboxylate ester of the formula $R^4(OCOR^5)_n(OH)_t$ wherein $R^4$ is a hydrocarbyl group containing 3 to 6 carbon atoms, $R^5$ is a hydrocarbyl group containing 6 to 25 carbon atoms, n is 1 to 3 and t is 2 or 3.

17. The method of claim 16 wherein said alkyl groups are tertiary alkyl groups.

18. The method of claim 16 wherein said hydrocarbyl groups are selected from the group consisting of alkyl, alkenyl, cycloalkyl, aryl, aralkyl and alkaryl.

19. The method of claim 16 wherein the hindered phenol is 2,6-di-tert-butyl-4-methylphenol, the boron compound is boric acid and the carboxylate ester is glycerol monooleate.

20. The method of claim 16 wherein said lubricant is (1) a mineral lubricating oil, (2) a synthetic lubricating oil or mixtures thereof, (3) mixtures of (1) and (2) and (4) a grease from any of (1), (2) and (3) and the liquid fuel is a liquid hydrocarbon a liquid alcohol fuel or mixtures thereof.

21. The composition of claim 5 containing additionally one or more additives selected from the group consisting of metal phenates, metal sulfonates, zinc phosphorodithioates, polymeric detergents and silicone defoamants.

22. The product of claim 1 wherein the hindered phenol is 2,6-di-tert-butyl-4-methylphenol, the boron compound is tributyl borate and the carboxylate ester is glycerol monooleate.

23. The composition of claim 5 wherein the hindered phenol is 2,6-di-tert-butyl-4-methylphenol, the boron compound is tributyl borate and the carboxylate ester is glycerol monooleate.

24. The method of claim 16 wherein the hindered phenol is 2,6-di-tert-butyl-4-methylphenol, the boron compound is tributyl borate and the carboxylate ester is glycerol monooleate.

* * * * *